US006733115B2

(12) United States Patent
Santhanam et al.

(10) Patent No.: US 6,733,115 B2
(45) Date of Patent: May 11, 2004

(54) INK-JET PEN WITH TWO-PART LID AND TECHNIQUES FOR FILLING

(75) Inventors: Ram Santhanam, San Diego, CA (US); Jose L. Ortega, Aguadilla, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/152,891

(22) Filed: May 21, 2002

(65) Prior Publication Data

US 2002/0196317 A1 Dec. 26, 2002

Related U.S. Application Data

(63) Continuation of application No. 09/675,345, filed on Sep. 28, 2000, now abandoned, which is a continuation-in-part of application No. 09/477,843, filed on Jan. 5, 2000, now Pat. No. 6,161,920, and a continuation-in-part of application No. 09/477,645, filed on Jan. 5, 2000, now Pat. No. 6,332,676.

(51) Int. Cl.[7] ..... B41J 2/175
(52) U.S. Cl. ..... 347/85; 547/30
(58) Field of Search ..... 347/85, 86, 87, 347/28, 30, 89

(56) References Cited

U.S. PATENT DOCUMENTS 5,210,550 A * 5/1993 Fisher et al. ..... 347/30
5,504,510 A * 4/1996 Miyakawa ..... 347/85
5,793,389 A * 8/1998 Michell ..... 347/28
5,936,650 A * 8/1999 Ouchida et al. ..... 347/89
6,172,695 B1 * 1/2001 Lui ..... 347/85

FOREIGN PATENT DOCUMENTS

EP 1057644 A2 * 6/2000 ..... B41J/2/175

* cited by examiner

*Primary Examiner*—Anh T. N. Vo

(57) ABSTRACT

A technique for dispensing ink into an inkjet cartridge. An ink filling kit includes an ink supply including at least one ink chamber for holding a fill supply of liquid ink, and at least one protruding needle in communication with each ink chamber. The kit can include a vacuum system for applying a vacuum to the nozzle array of the printhead nozzle array to draw air through the nozzle array. A method for filling an inkjet cartridge includes providing an ink supply including at least one ink chamber for holding a fill supply of liquid ink, and at least one protruding needle in communication with the ink chamber, holding the inkjet cartridge in a position during a fill procedure relative to the ink supply, wherein the needle extends into internal ink reservoir, dispensing ink from the ink supply through the needle into the ink reservoir, and applying a vacuum to the nozzle array of the printhead nozzle array during the fill procedure to draw air through the nozzle array. The cartridge can include a two part lid structure, including a lid portion for permanent attachment to the housing, and a cover portion having a closed position for covering at least one fill port in the lid structure, the cover portion movable to allow access to the at least one fill port.

21 Claims, 7 Drawing Sheets

INK-JET PEN WITH TWO-PART LID AND TECHNIQUES FOR FILLING

CROSS-REFERENCE TO RELATED APPLICATION

This is a continuation of application Ser. No. 09/675,345 filed on Sep. 28, 2000 now abandoned, which is hereby incorporated by reference herein.

This application is a continuation-in-part of application Ser. No. 09/477,843, filed Jan. 5, 2000 now U.S. Pat. No. 6,161,920, TECHNIQUES FOR ADAPTING A SMALL FORM FACTOR INK-JET CARTRIDGE FOR USE IN A CARRIAGE SIZED FOR A LARGE FORM FACTOR CARTRIDGE, by Ram Santhanam, and also of application Ser. No. 09/477,645, filed Jan. 5, 2000 now U.S. Pat. No. 6,332,676, A VENT FOR AN INK-JET PRINT CARTRIDGE, by Ram Santhanam, the entire contents of which are incorporated herein by this reference.

TECHNICAL FIELD OF THE INVENTION

This invention relates to ink-jet printing, and more particularly to filling techniques for ink-jet pens and to case structures for such pens.

BACKGROUND OF THE INVENTION

Ink-jet printers are in widespread use today for printing functions in personal computers, graphics plotters, facsimile machines and other applications. Such printers typically include replaceable or semipermanent print cartridges which hold a supply of ink and carry the ink-jet printhead. The cartridge typically is secured into a printer carriage which supports one or a plurality of cartridges above the print medium, and traverses the medium in a direction transverse to the direction of medium travel through the printer. Electrical connections are made to the printhead by flexible wiring circuits attached to the outside of the cartridge. The carriage receptacle has a corresponding electrical circuit with exposed contact pads which contact cartridge interconnect pads when the cartridge is mounted in the carriage. Each printhead includes a number of tiny nozzles defined in a substrate and nozzle plate structure which are selectively fired by electrical signals applied to the interconnect pads to eject droplets of ink in a controlled fashion onto the print medium. The cartridge may be connectable to auxiliary supplies of ink for replenishing the internal supply held in the cartridge.

In order to achieve accurate printing quality, each removable cartridge includes datum surfaces which engage against corresponding carriage surfaces to precisely locate the cartridge when inserted into the carriage. In this manner, when a cartridge ink supply is exhausted, the cartridge may be replaced with a fresh cartridge, and the printhead of the new cartridge will be precisely located relative to the carriage. The printer carriage receptacle and the cartridge are therefore designed together, so that the cartridge fits accurately within the carriage receptacle, the respective circuit pads and datum surfaces match up, and the cartridge can be removed and replaced with a fresh cartridge as needed.

SUMMARY OF THE INVENTION

In accordance with an aspect of the invention, an ink filling kit is described for dispensing ink into an inkjet cartridge having a printhead nozzle array in fluid communication with at least one internal ink reservoir. The kit includes an ink supply including at least one ink chamber for holding a fill supply of liquid ink, and at least one protruding needle in communication with the at least one ink chamber. The kit can include a vacuum system for applying a vacuum to the nozzle array of the printhead nozzle array during the fill procedure to draw air through the nozzle array. A fixture system can also be provided to hold the inkjet cartridge in position during a fill procedure.

In accordance with a further aspect of the invention, a method is described for filling an inkjet cartridge having a printhead nozzle array in fluid communication with at least one internal ink reservoir. The method includes:

- providing an ink supply including at least one ink chamber for holding a fill supply of liquid ink, and at least one protruding needle in communication with the at least one ink chamber;
- holding the inkjet cartridge in a fixtured position during a fill procedure relative to the ink supply, wherein the at least one protruding needle extends into the at least one internal ink reservoir of the cartridge;
- dispensing ink from the ink supply through the at least one needle into the at least one ink reservoir; and
- applying a vacuum to the nozzle array of the printhead nozzle array during the fill procedure to draw air through the nozzle array.

In accordance with another aspect of the invention, an inkjet cartridge usable with the fill kit includes a cartridge housing having an open region, a printhead mounted on the housing, at least one internal ink reservoir defined within the housing in fluid communication with the printhead, and a foam structure disposed within the at least one internal ink reservoir. A two part lid structure is provided for covering the open region of the housing, the lid structure including a lid portion for permanent attachment to the housing, and a cover portion having a closed position for covering at least one fill port in the lid structure, the cover portion movable to allow access to the at least one fill port.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
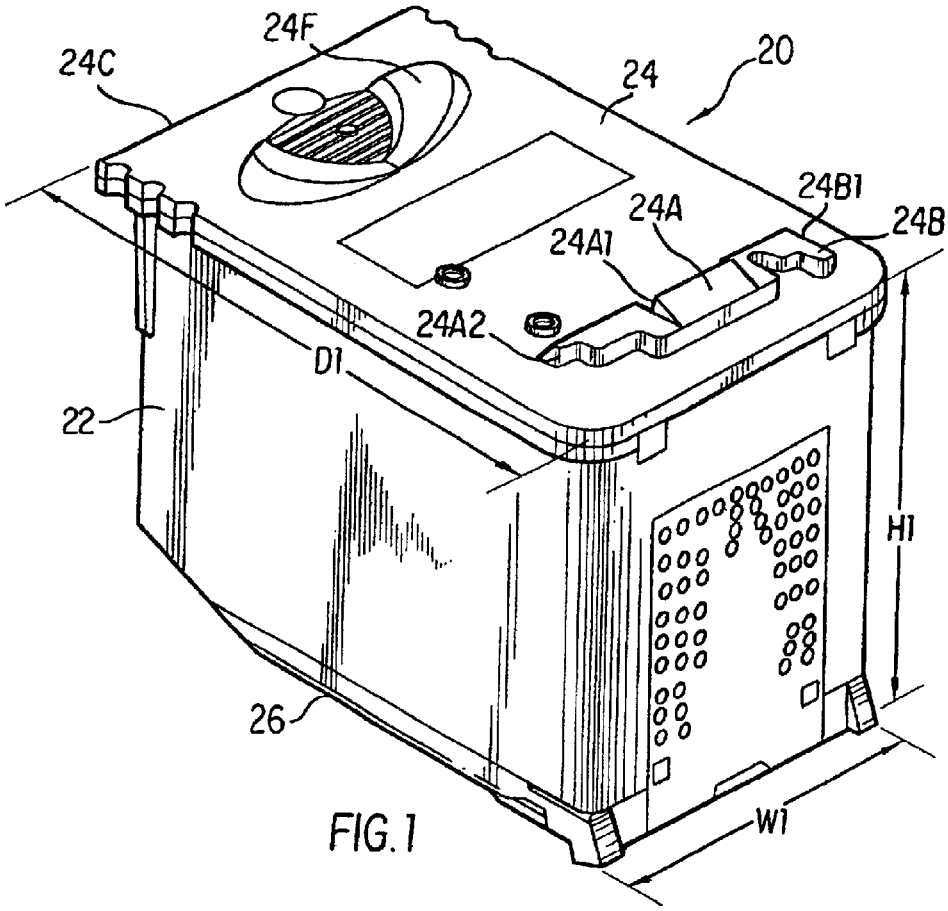
FIG. 1 is an isometric view of a small form factor inkjet cartridge with which the subject invention can be employed.

One aspect of this invention is a refill technique for a low profile inkjet print cartridge. One exemplary low profile cartridge is described in the above-referenced application, although other cartridges can alternatively be employed in practicing the invention. The following description of the exemplary cartridge is generally taken from the above reference application.

A small form factor inkjet cartridge 20 is shown in FIGS. 1–4, and is characterized by a relatively small height dimension H1, in this exemplary embodiment on the order of 45 mm. This is compared to a typical height dimension of 72 mm for the HP 51629A (black ink), 51629G (black ink), 51649A (tri-color) and 51649G (tri-color) cartridges marketed by Hewlett-Packard Company. The width dimension W1 and depth dimension D1 are the same as for these already marketed cartridges; typical values for W1 and D1 are 30.9 mm and 48.3 mm, respectively. The small form factor cartridge 20 has utility for a variety of applications, including by way of example low profile printing devices and entertainment center printers.

The cartridge 20 includes a cartridge housing 22, typically fabricated of a plastic material, to which a top end cap or lid 24 is attached, e.g. by adhesive or ultrasonic bonding techniques. A bottom end cap or nose piece 26 is attached to the lower end of the housing, and supports a printhead 28 (FIG. 2). The housing 22 has formed therein at least one ink reservoir chamber, filled with a foam material in this example, for holding a supply of ink to supply the printhead during printing operations for delivering ink droplets onto a print medium during printing operations. The ink compartments in this exemplary embodiment receive foam structures (not shown in FIG. 1) which hold the ink in open foam cells, and create slight negative pressure through capillary action, as is well known in the art. The ink reservoir includes an ink outlet port in fluid communication with each chamber.

The printhead is fabricated in this exemplary embodiment as part of a TAB flexible circuit attached to the housing, and the bottom end cap, and includes a plurality of ink ejection orifices generally indicated as 28A (FIG. 2) communicating with the supply of ink in the reservoir through a reservoir outlet port. The TAB circuit further includes a cartridge set of electrical contact pads, which are interconnected through the TAB circuit to corresponding nozzle firing resistors of the thermal inkjet printhead. When the cartridge is mounted in a carriage receptacle, the cartridge set of contacts is brought into contact with a corresponding set of carriage contacts, for supplying drive signals to the printhead. Other types of cartridge reservoirs, printheads, and circuits can alternatively be employed without departing from the invention.

Figure 3:
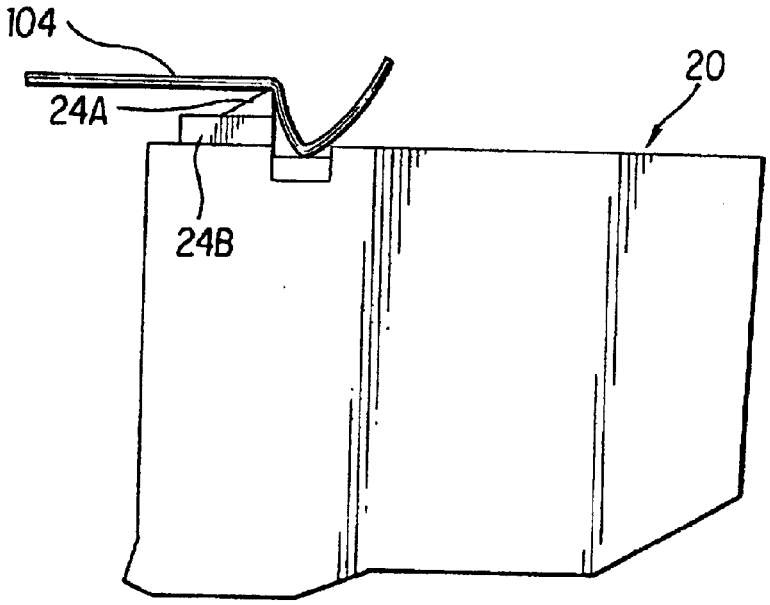
FIG. 3 is a simplified side view illustrating the latching of the cartridge of FIG. 1 in a carriage receptacle.

The top cap or lid 24 of the cartridge body has formed as an integral part thereof a boss or beveled latch feature 24A, and a keying feature 24B. The latch feature 24A is adapted to provide a latching surface against which a carriage latch member engages as the cartridge is inserted into a carriage receptacle adapted to receive the cartridge. This is illustrated in FIG. 3, wherein a cantilevered latch spring 104 is shown in a latched position relative to the cartridge body. The keying feature 24B is adapted to match with corresponding receptacle keying features, when the cartridge is mounted in the carriage receptacle.

Figure 4:
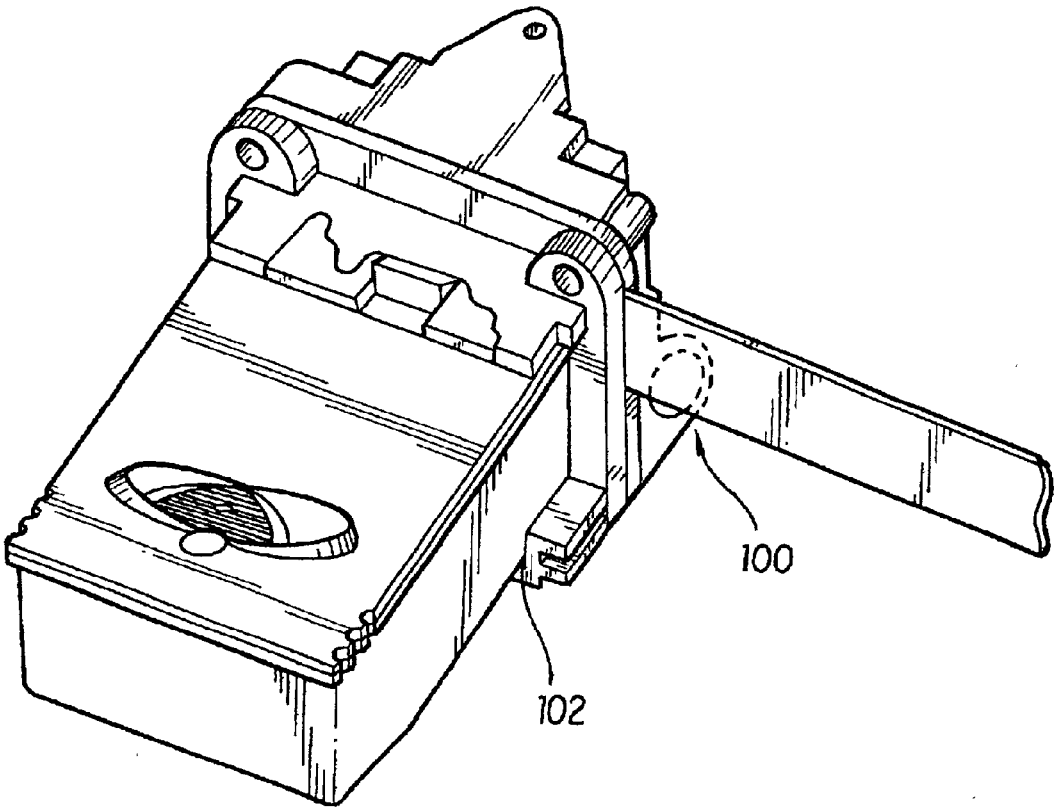
FIG. 4 is an isometric view of the cartridge of FIG. 1 mounted in a carriage receptacle.

FIG. 4 illustrates the cartridge 20 mounted in a carriage 100, and particularly in a carriage receptacle 102 which is dimensioned particularly to receive the cartridge 20. The cartridge and the receptacle are particularly adapted for use as a front loading system, wherein the cartridge is inserted in a sideways-facing receptacle opening or guide chute. The guide chute can be formed as an injection molded part, with short sidewall structures on the bottom and left and right sides of the chute. A carriage latch feature 104 and a receptacle keying feature 106 are formed at the top side of the receptacle chute. Thus, the guide chute is formed on three sides by short walls which extend only along a short portion of the cartridge body. To load the cartridge 20 into the receptacle carriage receptacle, the bottom of the cartridge is first inserted into the guide chute at an angle, and then the back of the cartridge is pushed back to engage the latch spring over the latch feature of the cartridge.

In accordance with an aspect of the invention, a refill kit 150 is described which provides an apparatus to fill or refill a multi-compartment inkjet cartridge such as the cartridge 20. In one exemplary embodiment, the main components of the refill system 150 are a refill station including a fixture 190, an ink supply 160 which includes fill needles, a capping system 180 to provide a seal around the cartridge nozzle arrays to evacuate air and prime the cartridge when it is refilled, a vacuum source 192 to connect to the capping system, and the tool(s) 194, 196 to make the necessary refill ports in the top lid of the cartridge, for the cartridge type employing a non-removable lid. As will be described more fully below, an alternate embodiment employs a removable lid or cover on the cartridge to expose the fill ports.

Figure 5B:
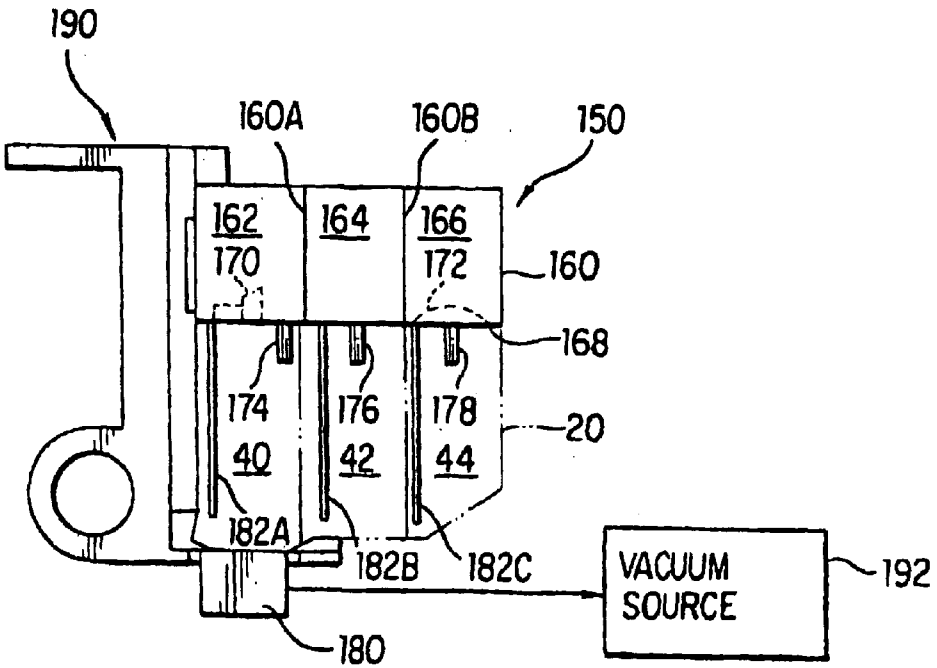
FIG. 5B is a schematic illustration of the cartridge with elements of the refill kit during a refill procedure.

FIG. 5B illustrates a technique using a refill ink container 160 comprising the refill kit. The refill container 160 in this embodiment includes an integrated housing structure, wherein the exterior walls and interior walls 160A, 160B define a plurality of ink chambers 162, 164, 166.

The housing 160 has a bottom surface 168, which includes keying features which mate with the features 24B formed on the top lid 24 of the cartridge 20, and a recess to clear the push feature 24F formed on the top lid. In the exemplary embodiment of FIG. 5B, the bottom surface 168 has formed therein keying feature 170 at the bottom of the first chamber 162, to ensure that the correct refill kit is used with the particular cartridge 20. The bottom surface 168 further has formed therein the recess 172 at the bottom of the third chamber 166 to clear the push feature 24F protruding from the surface of the lid.

In this exemplary embodiment, the chambers 162, 164, 166 are sized to provide equal volumes for holding liquid ink to refill the corresponding ink chambers 40, 42, 44 of the inkjet cartridge 20, regardless of the volume taken up for the key feature 172 and the recess feature 172.

A plurality of hollow fill needles 174, 176, 178 protrude downwardly from the bottom surface 168 of the ink container 160. The fill needles are each in fluid communication with a corresponding ink chamber of the container 160. The needles are designed to penetrate the foam within the chambers 40, 42, 44 of the cartridge 20 to a predetermined depth to ensure good ink fill.

It will be appreciated that some cartridges will have a single chamber, e.g. a black ink cartridge. In this case, the refill container 160 corresponding to this cartridge can be constructed as well with a single large chamber, preferably with three fill needles, although the number of needles can be varied according to the requirements of a particular application. Alternatively, a three chamber refill supply as shown in FIG. 5B can be employed, with all three chambers holding the same type and color of ink, so that a single large compartment in the cartridge 20 is refilled by ink from a plurality of chambers in the refill supply.

In this exemplary embodiment, the refill station includes a housing or fixture 190 to fixture the pen, and an apparatus including capping system 180 and vacuum source 192 to apply vacuum to the nozzle plate. The fixture 190 can be a stand-alone fixture, which can include bracketry to hold the ink container 160 and the cartridge 20 during the refill procedure. In an alternate embodiment, the capping station in the printer is adapted to serve as the refill station. This is generally shown in FIG. 5B. In this case, an "Out of Ink (OOI)" message generated by the printer controller can be used to trigger the start of the refill cycle, either automatically or to prompt the user to refill the cartridge. The OOI message along with the correct carriage position can be stored in the printer registers and transferred to the refill station, which may be part of the printer or a separate unit. In another embodiment, the fixture or filling station can be built into the printer housing structure, similar to the humidor/garage supplied with single pen printers, e.g. the Hewlett Packard DeskJet 500C printer, to store the unused cartridge.

The vacuum required to perform the ink fill may be applied by a manual prime pump, a small vacuum pump or by fittings to attach to a house vacuum cleaner. The vacuum may not be required to fill an already wet foam but can be used to evacuate the pen so as to start the fill process at a known empty point. This can be especially useful when filling a tri-chamber pen, where the overall weight of the pen does not necessarily indicate the residual ink in each of the three chambers.

Another optional component of the refill station is an ink level monitor to determine whether refill is needed (when the refilling is done manually) or when to stop filling ink. The "full" message will be sent to the ink supply either electronically or mechanically to ensure that an already full pen is not refilled thereby causing an ink spill. The ink fill level sensing system can include ink level sensors 182A, 182B, 182C (FIG. 5B) which indicate the ink level in the respective chambers 40, 42, 44 of the cartridge during the fill procedure.

The ink supply 160 may be a single or multi-chamber structure, depending on the cartridge it is designed to refill. The ink supply also preferably has hollow fill needles (or other suitable device) to penetrate the foam. There will also be a method to shut off the fill when the optimum level is reached. Another approach is to combine the needle and a sensor to sense ink level using electrical impedance or capacitance.

The capacity of the ink supply 160 can be selected in dependence on the capacity of the ink cartridge reservoir(s), and the refill operation conducted on an empty or almost empty ink cartridge. In this embodiment, the refill proceeds until all available ink in the ink supply 160 has been dispensed into the ink cartridge. The needles can be capped until ready for use. A closable vent can be proved in a top surface of the ink supply 160, and opened after the needles have been inserted into the fill port of the cartridge. Application of vacuum on the nozzle array of the cartridge then facilitates refilling the cartridge.

Figure 5A:
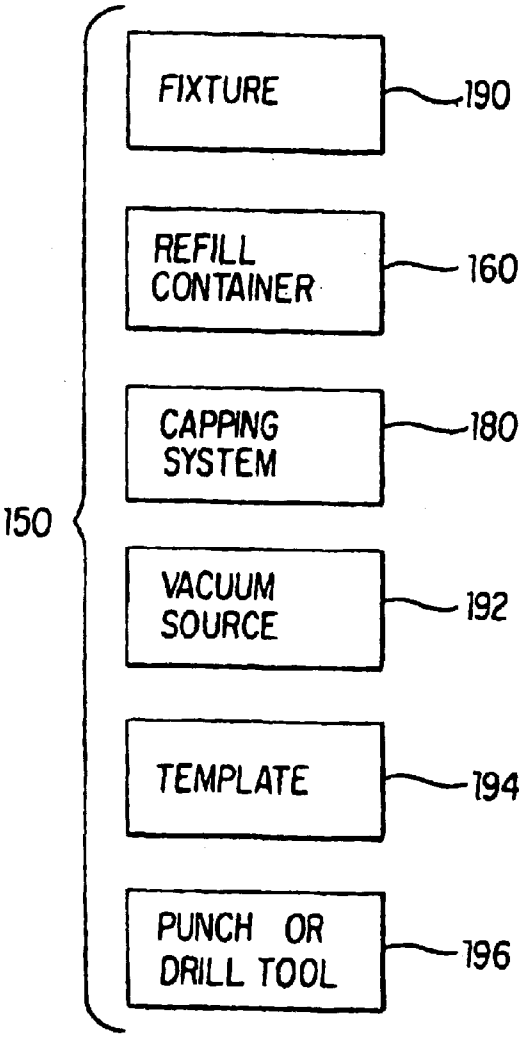
FIG. 5A is a schematic diagram illustrating exemplary components of a refill kit useful in a technique for refilling an inkjet cartridge in accordance with an aspect of the invention.

In another embodiment, the ink supply needles can be provided with a normally closed needle valve arrangement, such as the needle valve structure 120 described in U.S. Pat. No. 5,929,883, and illustrated in FIGS. 4–6. In this embodiment, the needle valve is opened when the ink supply 160 and the cartridge are brought together and the needle inserted into the cartridge through its fill port. The valve structure can include a collar biased by a spring to a normally closed position, but when the needle is passed into the fill port, the collar is forced up the needle to expose needle openings, allowing ink to flow.

Other techniques for controlling the flow of ink from the ink supply to the ink cartridge can also be employed.

The ink supply 160 can also be designed in such a way that the first chamber 162 has keying features 170 to ensure that the correct ink supply is used for a given pen which is unique, as described more fully in pending application Ser. No. 09/477,940, filed Jan. 5, 2000, MULTI-BIT MATRIX CONFIGURATION FOR KEY-LATCHED PRINTHEADS, by Ram Santhanam et al., the entire contents of which are incorporated herein by this reference. In addition the third chamber has a recess or cut out 172 to clear the push feature 24F of the cartridge 20. The individual chamber geometry will be chosen in such a way that each chamber contains the required amount of ink regardless of the volume taken up to implement the keys and to clear the push feature.

Figure 6:
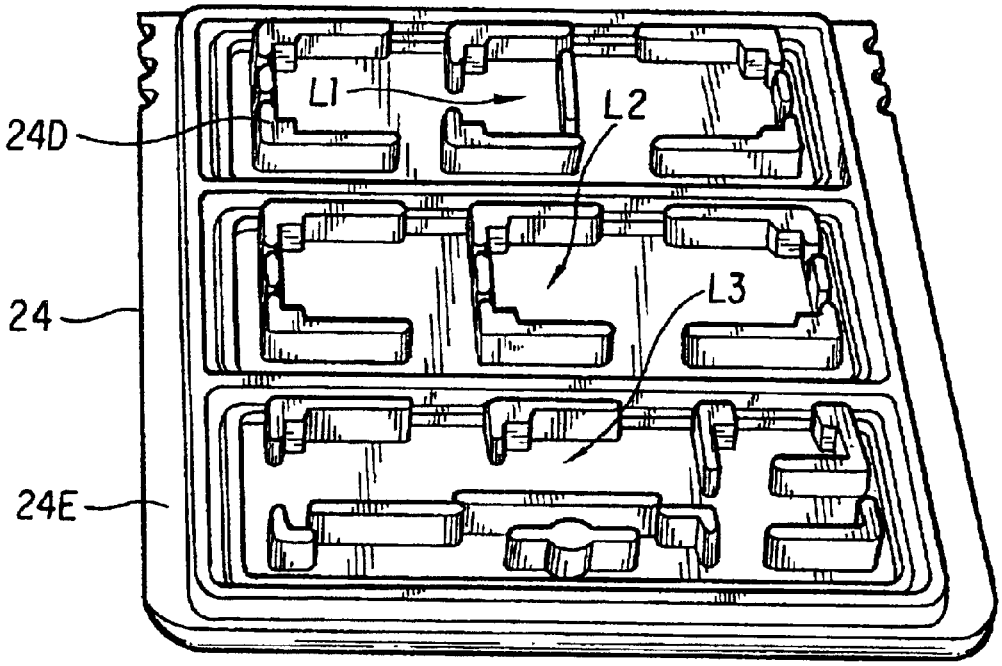
FIG. 6 is a bottom isometric view of a one-piece lid structure.
Figure 7:
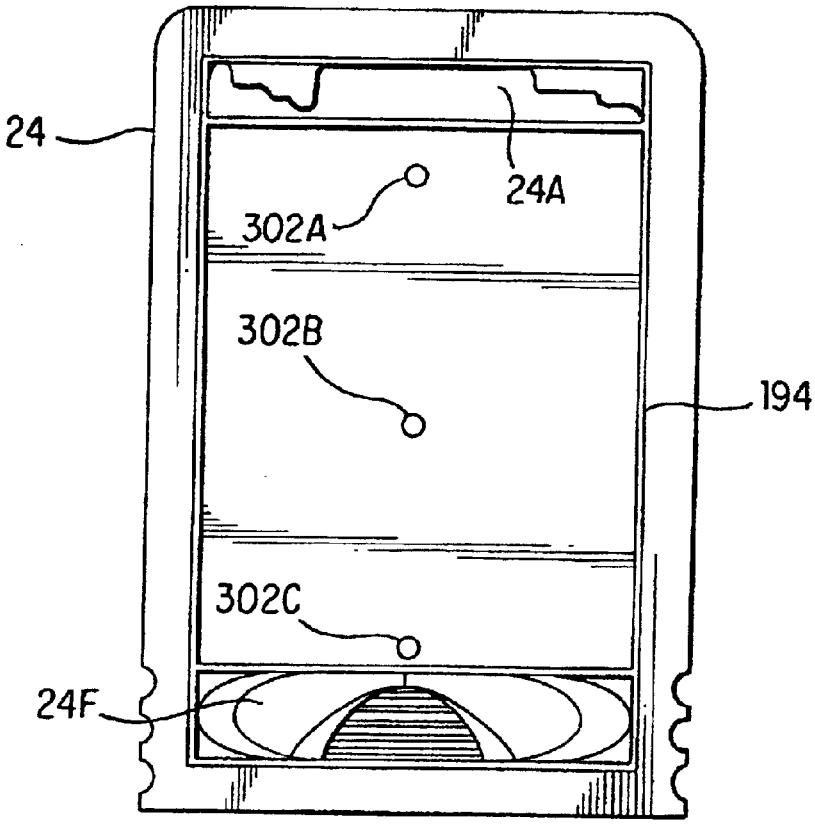
FIG. 7 is a top view of the lid structure of FIG. 6 with a template in place to identify locations of fill ports.

The top lid 24 of the cartridge 20 may or may not have exposed fill ports on all chambers to enable filling. In one exemplary embodiment, the lid 24 does not include exposed fill ports. In this case, the cartridge is filled with ink at the factory before the lid is mounted to the housing. This lid 20 has several structures 24D protruding from the undersurface 24E of the lid, as illustrated in FIG. 6. These structures 24D serve as push features to apply compression force on the foam which is fitted into the ink chambers of the cartridge 20. To allow the cartridge to be refilled with ink, one or more fill ports are formed through the lid 24, e.g. by punching or drilling. The holes are preferably formed in appropriate locations in the lid to avoid the structures 24D. A tool can be provided to enable location of the fill port in the optimum location for each chamber. One simple technique is to provide a paper template for the user to place over the lid 24. The key/latch feature 24B and the thumb grip 24F can locate the template on the lid. The template has port indicia 302A–302C which indicate the locations of the fill ports to be formed in the lid, and which match the optimum locations L1–L3 (FIG. 6) which avoid the structures 24D. If the holes are punched, the punch tool can be included in the refill kit. Alternatively, for drilling the fill port holes, a drill bit size can be specified for the customer to purchase separately from a local hardware store.

After filling, the fill port holes can be left exposed, and the cartridge back pressure will tend to prevent ink stored in the foam from leaking. Alternatively, the fill port holes can be sealed with plugs or with tape, such as adhesive tape.

According to another aspect of the invention, the inkjet cartridge 20 is provided with a two-part lid to facilitate easy refill by users, improved manufacturing flow, improved water loss performance for entertainment center environments, and minimize/eliminate ink leaks through a vent hole.

The two-part lid includes one part permanently affixed to the cartridge housing, the lid and a second part, the cover, which has the push feature (24F) for insertion and removal of the cartridge. The cover can be removed easily by the user, either with a simple tool such as a screwdriver or no tools at all, depending on the particular implementation. For example, depending on the embodiment, the cover can be opened by sliding off of the back of the lid, by tilting the cover to either of the lid sides, or to the front or the back of the lid, or by removing the cover vertically from the permanently attached lid. Opening the cover exposes the fill ports for the three chambers, which can then be filled by use of the refill kit described above.

Figure 8:
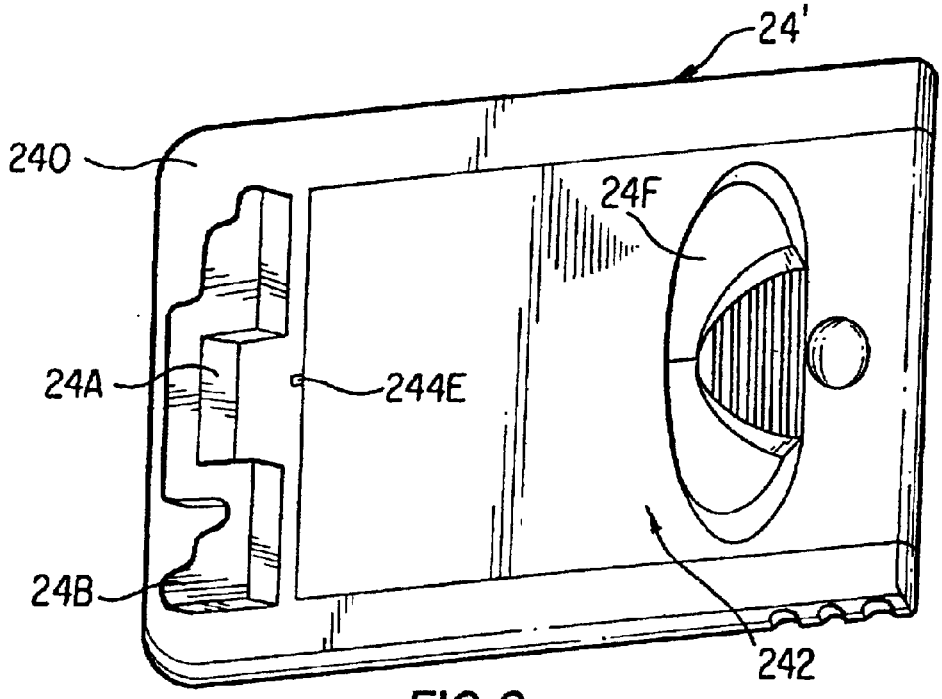
FIG. 8 illustrates an exemplary embodiment of a two-part lid structure in accordance with an aspect of the invention.

FIG. 8 illustrates an exemplary embodiment of the two-part lid structure 24', which includes the lid 240 which is adapted to be permanently affixed to the cartridge housing by ultrasonic welding, adhesive or other known attachment techniques. The lid structure 24' further includes a cover member 242, which can be moved from a closed position to expose fill ports formed in the lid useful for filling and refilling the cartridge. The push feature 24F is incorporated in the cover structure 242.

Figure 9:
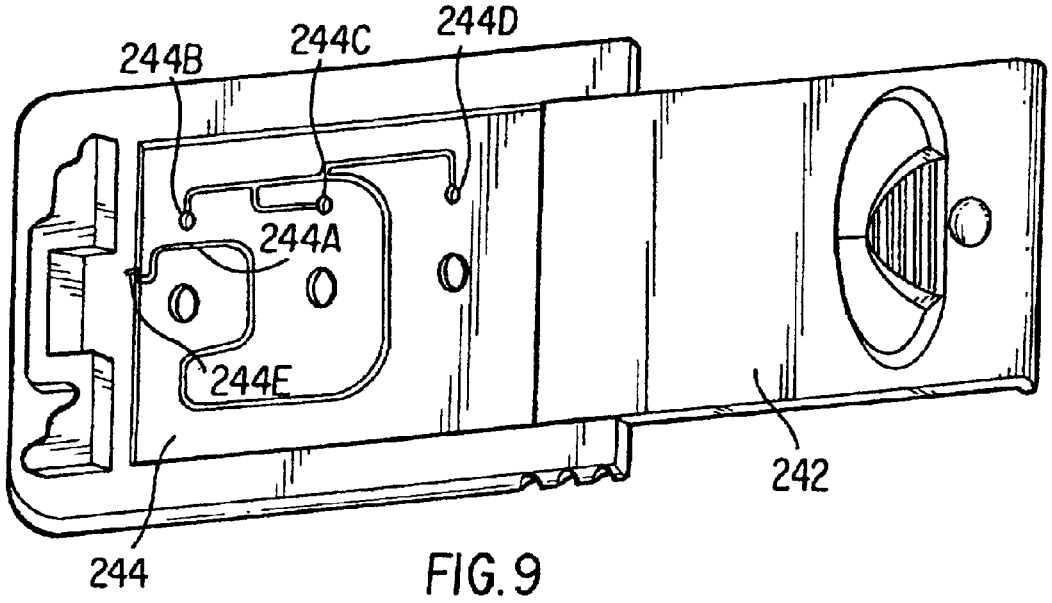
FIG. 9 is an isometric view of the lid structure of FIG. 8, showing the cover in an open position to expose the fill ports formed in the lid.

The lid structure further includes a labyrinth vent 244, illustrated in further detail in FIG. 9, an isometric view of the lid structure 24', showing the cover 242 in an open position. Here, the cover is slid out to a refill position to expose the fill ports 240A–240C formed in the lid 240. The labyrinth vent 244 is also exposed with the cover in the refill position. The vent includes a labyrinth groove 244A formed in the top surface of the lid 240, running from the vent openings 244B, 244C, 244D formed through the lid structure for each ink chamber to a terminal at 244E, which is exposed when the cover is in the closed position (FIG. 8).

The cover 242 and lid structure 240 illustrated in FIGS. 8 and 9 can be formed in a with a tongue-and-groove dovetail arrangement to prevent the cover from upward movement relative to the lid plane, while permitting lateral sliding movement of the cover relative to the lid 240.

Figure 10:
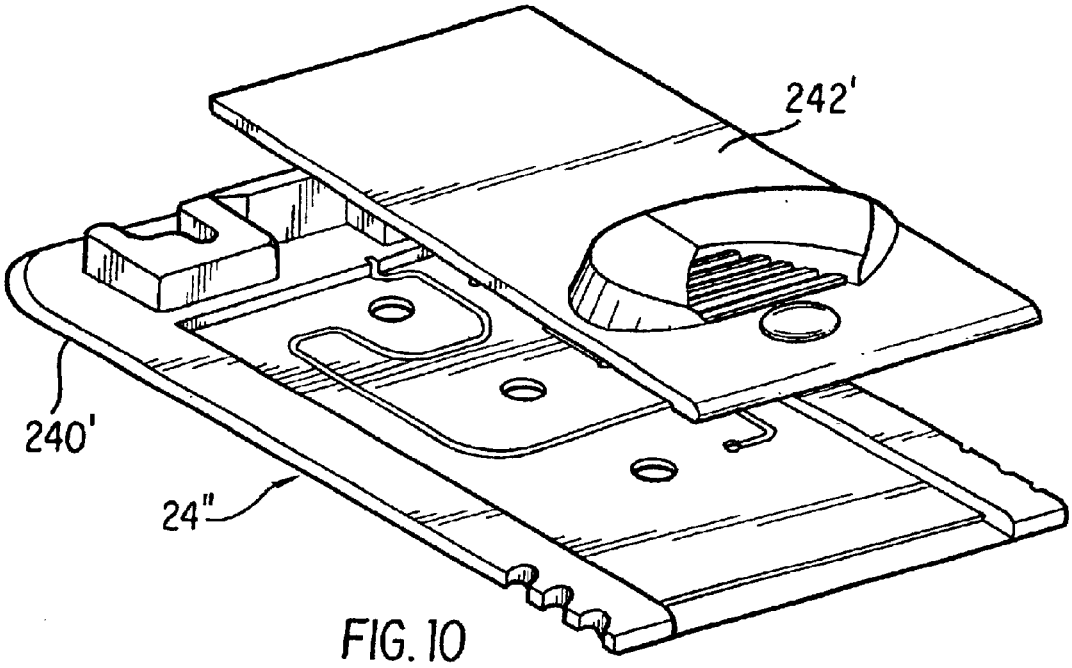
FIG. 10 shows an alternate arrangement of the two-part lid structure, which allows the cover to be lifted up and detached from the lid for refill.

FIG. 10 shows an alternate arrangement 24" of the lid 240' and cover 242', which allows the cover to be lifted up and detached from the lid 240' for refill. The cover 242' can snap fit onto the lid 240', or a clasp can be provided.

Figure 11:
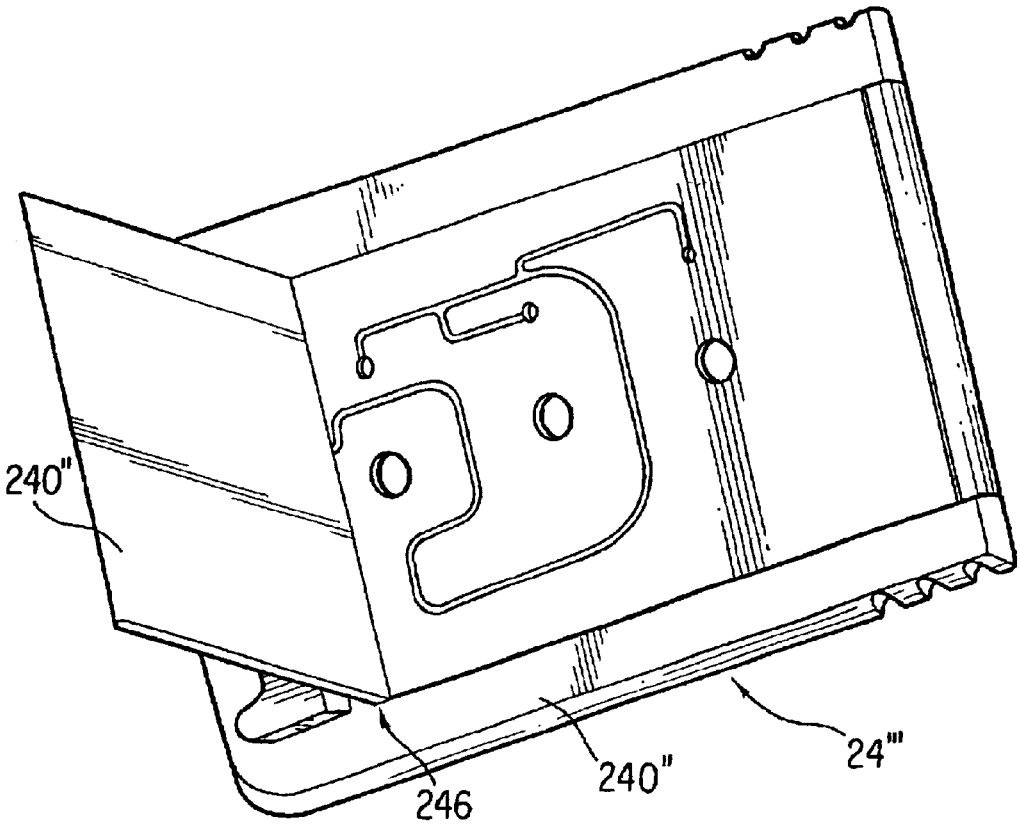
FIG. 11 is an isometric view illustrating a further alternative embodiment of the two-part lid structure, wherein the cover is attached to the lid structure with a hinge on the back of the lid structure.

FIG. 11 is an isometric view illustrating a further alternative embodiment 24"' of the two-part lid structure, wherein the cover 242" is attached to the lid 240" with a live hinge 246 on the back of the lid structure.

Figure 12:
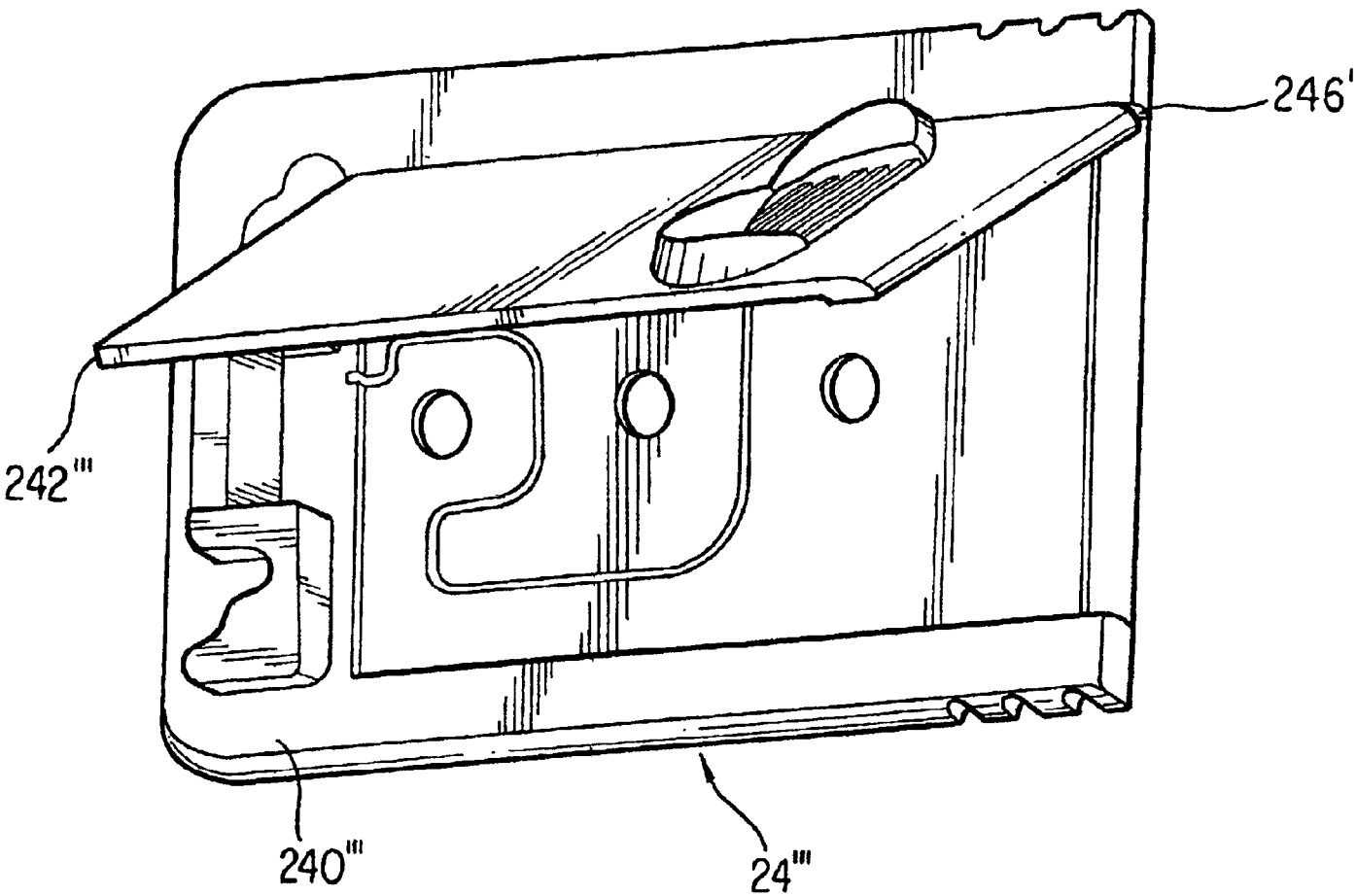
FIG. 12 is an isometric view illustrating an alternative embodiment of the hinged two-part lid structure, wherein the hinge is located along a longitudinal edge of the cover.

FIG. 12 is an isometric view illustrating an alternative embodiment of the hinged two-part lid structure 24", wherein the hinge 246' is located along a longitudinal edge of the cover 242"', instead of along a lateral edge as with the embodiment of FIG. 11.

The two-part lid 24 includes an improved vent to allow air to enter the ink chambers as ink is used, while minimizing vapor loss through the vent. With the cover portion in place, the vent path provided by the labyrinth groove 244A substantially reduces vapor loss. This enhances the performance of the print cartridge in hot and dry environments, e.g. an entertainment center environment. It is noted that labyrinth vents have been employed in the past, for example, in the Hewlett Packard model 51629 print cartridge. In that cartridge, however, the vent is not provided in a lid but in structure adjacent the nozzle array.

In addition to the improved water loss performance, the new vent design also helps in minimizing if not eliminate ink leaks through exposed vent holes.

Figure 2:
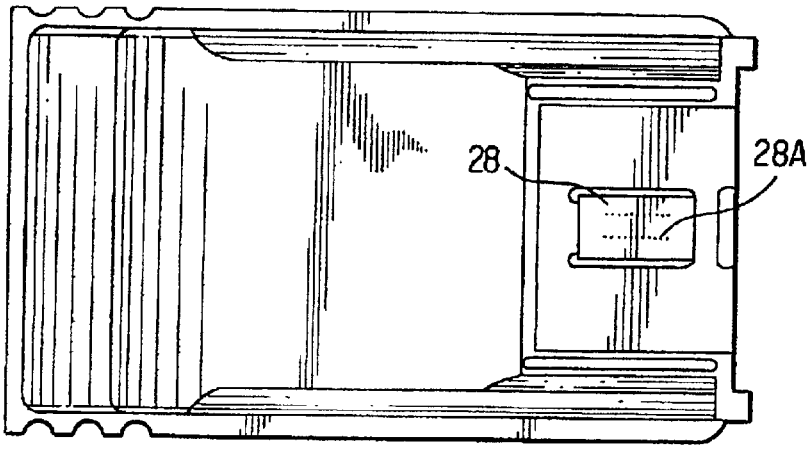
FIG. 2 is a bottom view of the cartridge of FIG. 1.

The cartridge 20 is illustrated in FIG. 1 as having a one-piece lid, permanently attached to the cartridge housing structure after ink fill by ultrasonic welding or other attachment technique. For high volume manufacturing, the cartridge is preferably built from start to finish in one run or at least from foam insertion to the end of line. The two-part lid will help in completing the dry loop processes and having inventory available to complete the assembly as demand arises without compromising the shelf life of the cartridge which takes effect when ink is filled.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An ink filling kit for an inkjet cartridge having a printhead nozzle array and at least one internal reservoir, comprising:

an ink supply including at least one ink chamber for holding a fill supply of liquid ink, and at least one protruding hollow needle in communication with said at least one ink chamber for passing through a fill port in a top cartridge wall and penetrating a cartridge capillary body during a fill procedure to dispense liquid ink from the fill supply into the capillary body only during the fill procedure, the at least one protruding hollow needle being removed from said fill port and out of contact with the capillary body during any printing operations for the inkjet cartridge, wherein the at least one internal reservoir of the cartridge includes a plurality of reservoirs, the at least one chamber of the fill supply comprises a corresponding plurality of chambers, and the at least one fill needle comprises a corresponding plurality of needles each in fluid communication with a corresponding chamber of the plurality of chambers; and a system for applying a vacuum to the nozzle array of the printhead nozzle array on a cartridge body wall opposite the top cartridge wall during the fill procedure while the at least one needle penetrates the capillary body.

2. The kit of claim 1 wherein the at least one needle is sized to extend into the capillary body by at least a predetermined depth during the fill procedure.

3. An ink filling kit for an inkjet cartridge having a printhead nozzle array and a top cartridge wall including a lid structure having a keying feature protruding therefrom, comprising:

an ink supply including at least one ink chamber for holding a fill supply of liquid ink, and at least one protruding hollow needle in communication with said at least one ink chamber for passing through a fill port in the top cartridge wall and penetrating a cartridge capillary body during a fill procedure to dispense liquid ink from the fill supply into the capillary body only during the fill procedure, the at least one protruding hollow needle being removed from said fill port and out of contact with the capillary body during any printing operations for the inkjet cartridge, wherein the ink supply includes a supply housing having a bottom surface from which the hollow needle protrudes for positioning adjacent the lid structure during the fill procedure, and the bottom surface has a supply housing keying feature formed therein for mating with the cartridge keying feature during the fill procedure; and a system for applying a vacuum to the nozzle array of the printhead nozzle array on a cartridge body wall opposite the top cartridge wall during the fill procedure while the at least one needle penetrates the capillary body.

4. The kit of claim 3 further comprising a fixture system for holding the inkjet cartridge in a fixtured position during the fill procedure outside of a printing system in which the inkjet cartridge is used during printing operations.

5. An ink filling kit for an inkjet cartridge having a printhead nozzle array and a top cartridge wall including a lid structure having a pushing feature protruding therefrom, comprising:

an ink supply including at least one ink chamber for holding a fill supply of liquid ink, and at least one protruding hollow needle in communication with said at least one ink chamber for passing through a fill port in the top cartridge wall and penetrating a cartridge capillary body during a fill procedure to dispense liquid ink from the fill supply into the capillary body only during the fill procedure, the at least one protruding hollow needle being removed from said fill port and out of contact with the capillary body during any printing operations for the inkjet cartridge, wherein the ink supply includes a supply housing having a bottom surface from which the hollow needle protrudes for positioning adjacent the lid structure during the fill procedure, and the bottom surface has a supply housing recess formed therein for mating with the cartridge pushing feature during the fill procedure; and a system for applying a vacuum to the nozzle array of the printhead nozzle array on a cartridge body wall opposite the top cartridge wall during the fill procedure while the at least one needle penetrates the capillary body.

6. An ink filling kit for an inkjet cartridge having a printhead nozzle array and a top cartridge wall fabricated without a fill port, comprising:

a template part for indicating the location of one or more fill ports to be formed in the top wall of the cartridge prior to commencement of the fill procedure;

an ink supply including at least one ink chamber for holding a fill supply of liquid ink, and at least one protruding hollow needle in communication with said at least one ink chamber for passing through the one or more fill ports in a top cartridge wall and penetrating a cartridge capillary body during a fill procedure to dispense liquid ink from the fill supply into the capillary body only during the fill procedure, the at least one protruding hollow needle being removed from the one or more fill ports and out of contact with the capillary body during any printing operations for the inkjet cartridge; and a system for applying a vacuum to the nozzle array of the printhead nozzle array on a cartridge body wall opposite the top cartridge wall during the fill procedure while the at least one needle penetrates the capillary body.

7. An ink filling kit for an inkjet cartridge having a printhead nozzle array and a top cartridge wall fabricated without a fill port, comprising:

an ink supply including at least one ink chamber for holding a fill supply of liquid ink, and at least one protruding hollow needle in communication with said at least one ink chamber for passing through a fill port in a top cartridge wall and penetrating a cartridge capillary body during a fill procedure to dispense liquid ink from the fill supply into the capillary body only during the fill procedure, the at least one protruding hollow needle being removed from said fill port and out of contact with the capillary body during any printing operations for the inkjet cartridge;

a tool for forming the fill port in the top wall of the cartridge; and a system for applying a vacuum to the nozzle array of the printhead nozzle array on a cartridge body wall opposite the top cartridge wall during the fill procedure while the at least one needle penetrates the capillary body.

8. The kit of claim 7 wherein the system for applying a vacuum includes a capping system for providing a seal around the nozzle array of the cartridge during the fill procedure.

9. An ink filling kit for an inkjet cartridge having a printhead nozzle array and at least one internal reservoir, comprising:

an ink supply including at least one ink chamber for holding a fill supply of liquid ink, and at least one protruding hollow needle in communication with said at least one ink chamber for passing through a fill port in a top cartridge wall and penetrating a cartridge capillary body during a fill procedure to dispense liquid ink from the fill supply into the capillary body only during the fill procedure, the at least one protruding hollow needle being removed from said fill port and out of contact with the capillary body during any printing operations for the inkjet cartridge, wherein the at least one internal ink reservoir includes a plurality of reservoir chambers each for holding ink of a different color, and wherein the at least one chamber of said ink supply comprises a corresponding plurality of ink supply chambers each for holding a quantity of ink of said different color; and a system for applying a vacuum to the nozzle array of the printhead nozzle array on a cartridge body wall opposite the top cartridge wall during the fill procedure while the at least one needle penetrates the capillary body.

10. The kit of claim 9 further comprising respective quantities of ink of different color disposed in said plurality of ink supply chambers.

11. The kit of claim 9 further comprising a quantity of ink disposed in said at least one chamber.

12. A method for filling an inkjet cartridge having a printhead nozzle array in fluid communication with a plurality of internal ink reservoirs each having disposed therein a capillary member for holding an internal reservoir supply of ink of a different color under negative pressure, the nozzle array being positioned on a cartridge body wall which is opposite to a top cartridge body wall, the method comprising:

providing an ink supply including a plurality of ink chambers each for holding a fill supply of liquid ink of said different color and having at least one protruding hollow needle in communication with the ink chamber;

holding the inkjet cartridge in a filling position during a fill procedure relative to the ink supply, wherein said at least one protruding needle extends through a fill port in the top cartridge body wall and into a corresponding internal ink reservoir of the cartridge;

dispensing ink of said different colors from the ink supply through the at least one needle into respective ink reservoirs;

applying a vacuum to the nozzle array of the printhead nozzle array during the fill procedure to draw air through the nozzle array; and withdrawing said at least one protruding needle from the fill port upon completion of the fill procedure so that the at least one protruding needle is disconnected from the inkjet cartridge during any printing operations.

13. A method for filling an inkjet cartridge having a printhead nozzle array in fluid communication with at least one internal ink reservoir having disposed therein a capillary member for holding an internal reservoir supply of ink under negative pressure, the nozzle array being positioned on a cartridge body wall which is opposite to a top cartridge body wall, the cartridge having a housing with an open region, and a two part lid structure for covering the open region of the housing, the lid structure including a lid portion for permanent attachment to the housing and defining said top wall, and a cover portion having a closed position for covering at least one fill port in the lid structure, said cover portion movable to allow access to the at least one fill port, the method comprising:

providing an ink supply including at least one ink chamber for holding a fill supply of liquid ink, and at least one protruding hollow needle in communication with said at least one ink chamber;

moving the cover portion to allow access to said at least one fill port;

holding the inkjet cartridge in a filling position during a fill procedure relative to the ink supply, wherein said at least one protruding needle extends through a fill port in the top cartridge body wall and into the at least one internal ink reservoir of the cartridge, said holding including inserting said at least one needle into said at least one fill port;

dispensing ink from the ink supply through the at least one needle into the at least one ink reservoir;

applying a vacuum to the nozzle array of the printhead nozzle array during the fill procedure to draw air through the nozzle array; and withdrawing said at least one protruding needle from the fill port upon completion of the fill procedure so that the at least one protruding needle is disconnected from the inkjet cartridge during any printing operations.

14. The method of claim 13 wherein said step of holding the cartridge includes mounting the ink supply and the cartridge in a fixture external to a printing system in which the cartridge is mounted during the printing operations.

15. The method of claim 13 further comprising:

filling the at least one chamber with a quantity of liquid ink to be dispensed during said dispensing step.

16. The method of claim 13, further comprising:

moving the cover portion to said closed position after said dispensing step.

17. An ink filling kit for an inkjet cartridge having a printhead nozzle array and a cartridge wall including a lid structure having a keying feature protruding therefrom, comprising:

an ink supply including at least one ink chamber for holding a fill supply of liquid ink, and at least one protruding hollow needle in communication with said at least one ink chamber for passing through a fill port in the cartridge wall and penetrating a cartridge capillary body during a fill procedure to dispense liquid ink from the fill supply into the capillary body only during the fill procedure, the at least one protruding hollow needle being removed from said fill port and out of contact with the capillary body during any printing operations for the inkjet cartridge, wherein the ink supply includes a supply housing having a surface from which the hollow needle protrudes for positioning adjacent the lid structure during the fill procedure, and said surface has a supply housing keying feature formed therein for mating with the cartridge keying feature during the fill procedure; and a system for applying a vacuum to the nozzle array of the printhead nozzle array during the fill procedure while the at least one needle penetrates the capillary body.

18. An ink filling kit for an inkjet cartridge having a printhead nozzle array and a cartridge wall including a lid structure having a pushing feature protruding therefrom, comprising:

an ink supply including at least one ink chamber for holding a fill supply of liquid ink, and at least one protruding hollow needle in communication with said at least one ink chamber for passing through a fill port in the cartridge wall and penetrating a cartridge capillary body during a fill procedure to dispense liquid ink from the fill supply into the capillary body only during the fill procedure, the at least one protruding hollow needle being removed from said fill port and out of contact with the capillary body during any printing operations for the inkjet cartridge, wherein the ink supply includes a supply housing having a surface from which the hollow needle protrudes for positioning adjacent the lid structure during the fill procedure, and said surface has a supply housing recess formed therein for mating with the cartridge pushing feature during the fill procedure; and a system for applying a vacuum to the nozzle array of the printhead nozzle array during the fill procedure while the at least one needle penetrates the capillary body.

19. An ink filling kit for an inkjet cartridge having a printhead nozzle array and a cartridge wall fabricated without a fill port, comprising:

a template part for indicating the location of one or more fill ports to be formed in the wall of the cartridge prior to commencement of a fill procedure;

an ink supply including at least one ink chamber for holding a fill supply of liquid ink, and at least one protruding hollow needle in communication with said at least one ink chamber for passing through the one or more fill ports in the cartridge wall and penetrating a cartridge capillary body during a fill procedure to dispense liquid ink from the fill supply into the capillary body only during the fill procedure, the at least one protruding hollow needle being removed from the one or more fill ports and out of contact with the capillary body during any printing operations for the inkjet cartridge; and a system for applying a vacuum to the nozzle array of the printhead nozzle array during the fill procedure while the at least one needle penetrates the capillary body.

20. An ink filling kit for an inkjet cartridge having a printhead nozzle array and a cartridge wall, comprising:

an ink supply including at least one ink chamber for holding a fill supply of liquid ink, and at least one protruding hollow needle in communication with said at least one ink chamber for passing through a fill port in the cartridge wall and penetrating a cartridge capillary body during a fill procedure to dispense liquid ink from the fill supply into the capillary body only during the fill procedure, the at least one protruding hollow needle being removed from said fill port and out of contact with the capillary body during any printing operations for the inkjet cartridge;

a tool for forming the fill port in the wall of the cartridge; and a system for applying a vacuum to the nozzle array of the printhead nozzle array during the fill procedure while the at least one needle penetrates the capillary body.

21. A method for filling an inkjet cartridge having a printhead nozzle array in fluid communication with at least one internal ink reservoir having disposed therein a capillary member for holding an internal reservoir supply of ink under negative pressure, the cartridge having a housing with an open region, and a two part lid structure for covering the open region of the housing, the lid structure including a lid portion for permanent attachment to the housing, and a cover portion having a closed position for covering at least one fill port in the lid structure, said cover portion movable to allow access to the at least one fill port, the method comprising:

providing an ink supply including at least one ink chamber for holding a fall supply of liquid ink, and at least one protruding hollow needle in communication with said at least one ink chamber;

moving the cover portion to allow access to said at least one fall port;

holding the inkjet cartridge in a filling position during a fill procedure relative to the ink supply, wherein said at least one protruding needle extends through a fill port in the top cartridge body wall and into the at least one internal ink reservoir of the cartridge, said holding including inserting said at least one needle into said at least one fill port;

dispensing ink from the ink supply through the at least one needle into the at least one ink reservoir;

applying a vacuum to the nozzle array of the printhead nozzle array during the fill procedure to draw air through the nozzle array; and withdrawing said at least one protruding needle from the fill port upon completion of the fill procedure so that the at least one protruding needle is disconnected from the inkjet cartridge during any printing operations.

* * * * *

UNITED STATES PATENT AND TRADEMARK OFFICE

CERTIFICATE OF CORRECTION

PATENT NO. : 6,733,115 B2
DATED : May 11, 2004
INVENTOR(S) : Santhanam et al.

It is certified that error appears in the above-identified patent and that said Letters Patent is hereby corrected as shown below:

Column 13,
Line 18, after “holding a” delete “fall” and insert in lieu thereof -- fill --;

Column 14,
Line 2, after “one” delete “fall” and insert in lieu thereof -- fill --.

Signed and Sealed this

Twenty-third Day of November, 2004

JON W. DUDAS
*Director of the United States Patent and Trademark Office*